US005742886A

United States Patent [19]

Snelling et al.

[11] Patent Number: 5,742,886

[45] Date of Patent: Apr. 21, 1998

[54] METHOD AND APPARATUS FOR REMOVING EDGE RAGGEDNESS FROM IMAGES

[75] Inventors: Christopher Snelling, Penfield; Dale R. Mashtare, Macedon, both of N.Y.

[73] Assignee: Xerox Corporation, Stamford, Conn.

[21] Appl. No.: 671,774

[22] Filed: Jun. 24, 1996

[51] Int. Cl.[6] ..... G03G 15/16

[52] U.S. Cl. ..... 399/296

[58] Field of Search ..... 399/296, 319

[56] References Cited

U.S. PATENT DOCUMENTS

| | | | |
|---|---|---|---|
| 4,701,042 | 10/1987 | Mimura et al. | 399/296 |
| 4,833,503 | 5/1989 | Snelling | 399/231 |
| 5,081,500 | 1/1992 | Snelling | 399/319 |
| 5,258,820 | 11/1993 | Tabb | 399/296 |
| 5,351,113 | 9/1994 | Pietrowski et al. | 399/296 |
| 5,539,506 | 7/1996 | Bean et al. | 399/296 X |
| 5,574,541 | 11/1996 | Folkins | 399/296 X |

*Primary Examiner*—William J. Royer
*Attorney, Agent, or Firm*—William A. Henry, II

[57] ABSTRACT

Developed image noise is reduced by momentarily breaking the close range forces holding toner non-uniformly to a charge retentive surface in an electrostatic image. The source of the image noise can be of a mechanical nature, such as, raking by carrier beads in conventional two component development. The short range forces are broken by applying ultrasonic vibration to the charge retentive surface.

10 Claims, 3 Drawing Sheets

METHOD AND APPARATUS FOR REMOVING EDGE RAGGEDNESS FROM IMAGES

FIELD OF THE INVENTION

The present invention relates to a method and apparatus for ultrasonically reducing developed toner image noise due to mechanical displacement and scavaging of toner by carrier beads, or bead chains, in conventional two component magnetic brush development.

BACKGROUND OF THE INVENTION AND PRIOR ART

Heretofore, a number of patents and publications have disclosed acoustically enhancing development, the relevant portions of which may be briefly summarized as follows:

U.S. Pat. No. 4,833,503 to Snelling, issued May 23, 1989, teaches a multi-color printer employing sonic toner release development. Development is accomplished by vibrating the surface of a toner carrying member and thereby reducing the net force of adhesion of the toner to the surface of the toner carrying member.

U.S. Pat. No. 5,081,500 to Snelling, issued Jan. 14, 1992, discloses an electrophotographic device wherein a vibratory element is employed to uniformly apply vibratory energy to the back side of a charge retentive member having a developed image on the front side thereof. The vibratory energy applied enables the transfer of toner across a gap in those regions characterized by non-intimate contact between the charge retentive member and a copy sheet.

U.S. Pat. No. 4,701,042 to Missura et al., issued Oct. 20, 1987 teaches the use of a corrective electrode positioned between the developing device and transferring device in a drum photoreceptor xerographic system with an AC bias applied to the corrective electrode to generate a vibrating electric field to improve the image quality of duplicated copies passing through the electric field. U.S. Pat. No. 5,539,506 to Bean et al., Jul. 23, 1996 discloses an apparatus for removing edge raggedness and background from tri-level images with a dipole post development member positioned downstream of a second development system. A vibrating member is disclosed as being used simultaneously with the dipole post development member to reestablish imaging fields of a first image area.

SUMMARY OF THE INVENTION

The present invention has for one object to provide a novel and useful printing apparatus which can overcome the drawbacks mentioned above and can provide excellent copies of fine lines and gradation without solid area image noise due to carrier development in two component development systems.

It is another object of the invention to reduce image noise (non-uniformities) by ultrasonically limiting two component developed toners on the photoreceptor prior to transfer to copy sheets so as to allow the toner to move laterally within boundaries defined by the latent electrostatic image pattern to their lowest energy state (uniformly spaced).

BRIEF DESCRIPTION OF THE DRAWINGS

The foregoing objects and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the low cost, image noise reducing apparatus and method in a copier/printer. However, it should be understood that the method and apparatus of the present invention could be used with any machine in which removal of image noise is desired regardless as to whether single component, two component or three component development systems are employed and the tri-level embodiment discussed hereinbelow is exemplary only and is not to be viewed as limiting the invention in any way.

Figure 1:
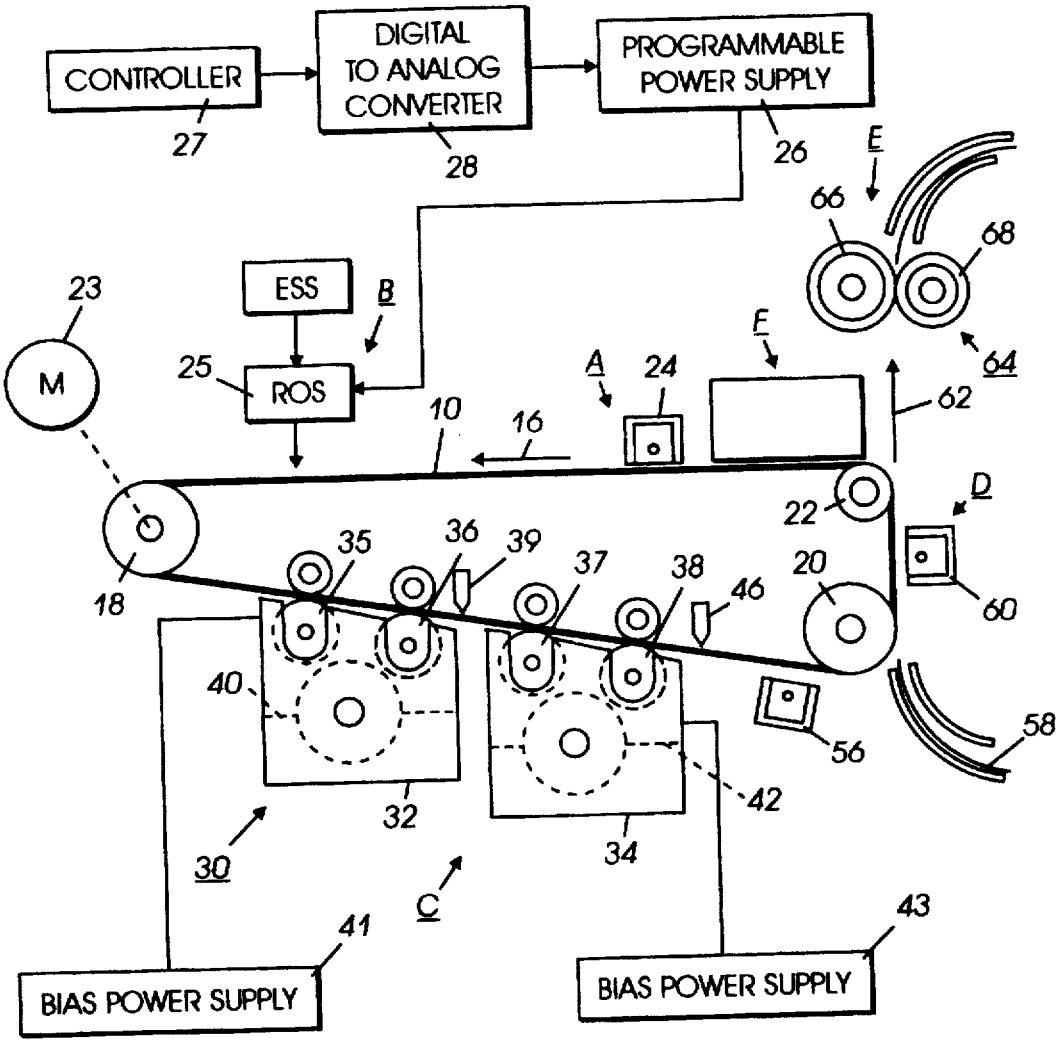
FIG. 1 is a schematic of a printing apparatus employing the image noise removal apparatus and method in accordance with the present invention.

As shown in FIG. 1, a printing machine incorporating the present invention may utilize a charge retentive member in the form of a photoconductive belt 10 consisting of a photoconductive surface and an electrically conductive substrate and mounted for movement past a charging station A, an exposure station B, developer stations C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as the belt drive.

As can be seen by further reference to FIG. 1, initially successive portions of the belt 10 pass through charging station A. At charging station A, a corona discharge device such as a scorotron, corotron or dicorotron indicated generally by the reference numeral 24, charges the belt 10 to a selectively high uniform positive or negative potential, $V_o$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface is exposed to a laser based input and/or output scanning device 25 which causes the charged retentive surface to be discharged in accordance with the output from the scanning device. Preferably the scanning device is a three level laser Raster Output Scanner (ROS). The ROS output is set via a programmable power supply 26 which is driven by means of a controller 27 via a digital to analog converter 28. Alternatively, the ROS could be replaced by a conventional xerographic exposure device.

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush developer rollers 37, 38. Each pair of rollers advances its respective developer material into contact with the latent image. Appropriate developer biasing is accomplished via power supplies 41 and 43 electrically connected to respective developer housings 32 and 34.

Color discrimination in the development of the electrostatic latent image is achieved by passing the photoreceptor past the two developer housings 32 and 34 in a single pass with the magnetic brush developer rolls 35, 36, 37 and 38 electrically biased to voltages which are offset from the background voltage, the direction of offset depending on the polarity of toner in the housing. One housing e.g. 32 (for the sake of illustration, the first) contains developer with black toner 40 having triboelectric properties such that the toner is driven to the most highly charged areas of the latent image by the electrostatic field (development field) between the photoreceptor and the specifically biased development rolls. Conversely, the triboelectric charge on colored toner 42 in the second housing is chosen so that the toner is urged towards parts of the latent image at residual potential by the electrostatic field (development field) existing between the photoreceptor and the development rolls in the second housing at a predetermined bias.

Figure 2:
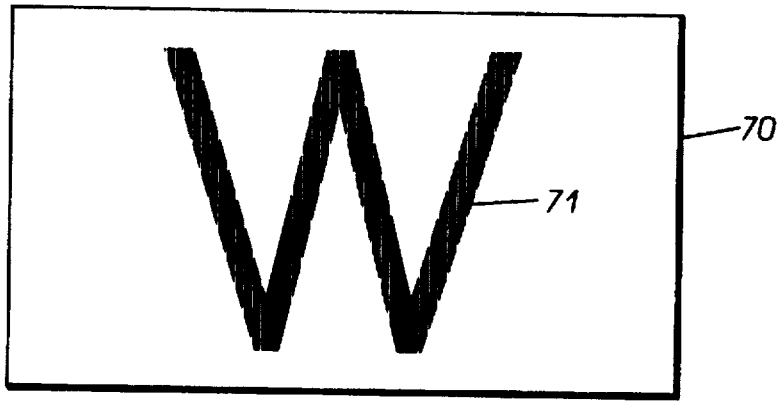
FIG. 2 is a top view of a photoreceptor that includes a noisy toner image thereon.
Figure 3:
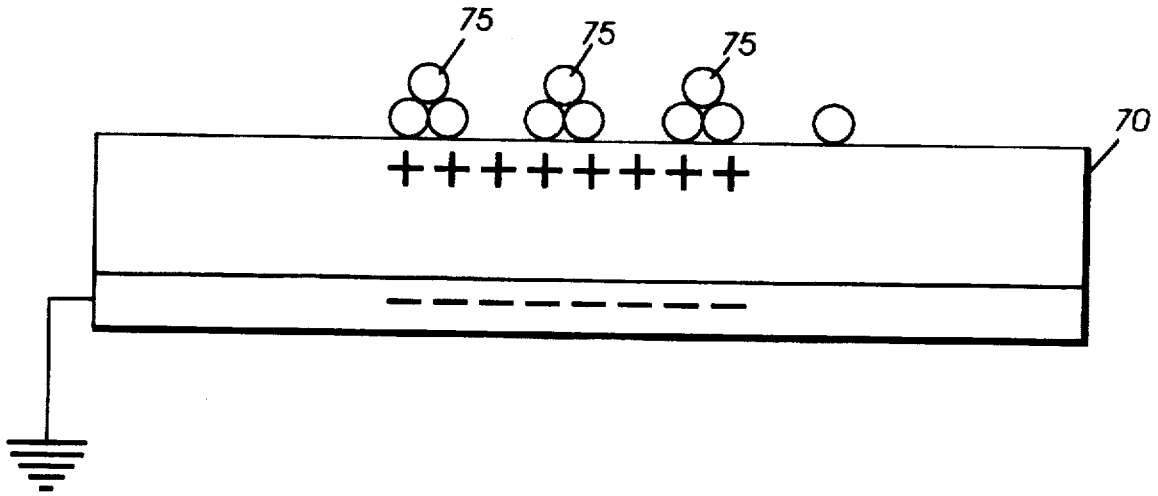
FIG. 3 is a side view of the photoreceptor of FIG. 2 showing the noisy image.
Figure 4:
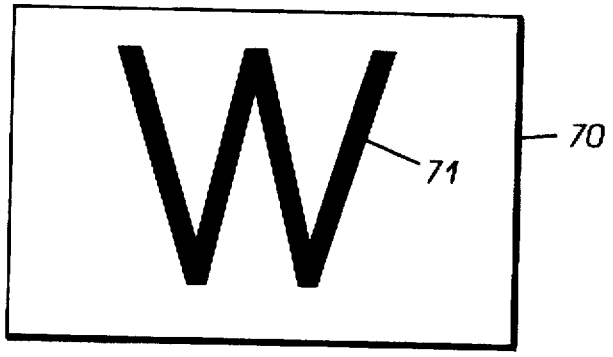
FIG. 4 is a top view of the photoreceptor of FIG. 2 that includes a low noise image.
Figure 5:
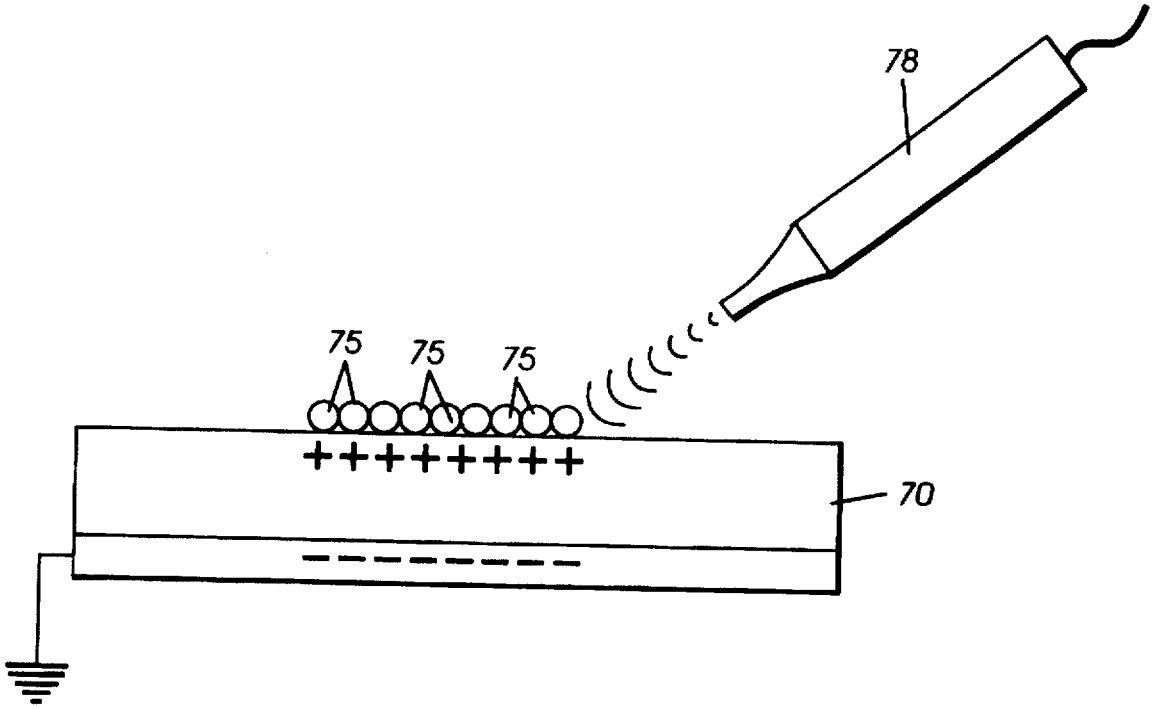
FIG. 5 is a side view of the photoreceptor of FIG. 2 with the low noise image of FIG. 4 with an ultrasonic horn added.

Non-uniformity of developed images brought about due to the mechanical displacement and scavenging of toners by carrier beads, or bead chains, has been tested and is shown in FIGS. 2, 3, 4, and 5. As an experiment, a stencil charged 1 mil aluminized Mylar represented by grounded member 70 was nominally cascade developed with toners 75. The developed toner image represented by 71 was then artificially made "hoisy" by raking through it with a polyester fiber "take" simulating the mechanical scrubbing action of carrier beads on developed toners as shown in FIGS. 2 and 3. Correction of the "noisy" toner image of FIGS. 2 and 3 in one aspect of the present invention is shown in FIGS. 4 and 5 where a uniform, low noise is obtained in FIG. 4 through air coupling acoustic energy member 78 as shown in FIG. 5 to the developed toner and Mylar to enhance the image. With the addition of air coupled acoustic energy to the toner image not only are solid area toner void lines filled in but toner image edge sharpness is clearly restored. It is clear from this demonstration that there exists an operating domain for pre-transfer image modification in which image-wise toner adhesion to the defined charge pattern on a charge retentive surface exceeds the inertial stripping forces (acoustic) necessary for the developed toners to easily redistribute by moving laterally.

With continued reference to FIG. 1, a degradation of an image on charge retentive surface due to image noise is reversed in accordance with the present invention by introducing acoustic transducers 39 and 46 that mechanically vibrate charge retentive surface after a developed image has left developer housing 32 for transducer 39 and after the image has left developer housing 34 with respect to transducer 46 During the time the charge retentive surface is vibrated by transducers 39 and 46, developed toner particles are levitated on the charge retentive surface in the absence of electric fields. The absence, or reduction, of toner adhesion to charge retentive surface through levitation during this pre-transfer image modification allows mutual repulsion of like-charged toner particles to uniformly distribute toners within the boundaries defined by the latent electrostatic image pattern on the charge retentive surface.

In operation, a sheet of support material 58 is moved into contact with the toner image at transfer station D. The sheet of support material is advanced to transfer station D by a conventional sheet feeding apparatus, not shown. Preferably, the sheet feeding apparatus includes a feed roll contacting the uppermost sheet of a stack of copy sheets. Feed rolls rotate so as to advance the uppermost sheet from the stack into a chute which directs the advancing sheet of support material into contact with the photoconductive surface of belt 10 in a timed sequence so that the toner powder image developed thereon contacts the advancing sheet of support material at transfer station D. Pre-transfer image modification devices 39 and 46 are actuated following development in order to improve image edge sharpness and solid area coverage prior to the composite developed image reaching the transfer station D.

Because the composite image developed on the photoreceptor consists of both positive and negative toner, a pre-transfer corona discharge member 56 is provided to condition the toner for effective transfer to a substrate using corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute guides the advancing sheet 58 to a catch tray (not shown) for subsequent removal from the printing machine by the operator.

After the sheet of support material is separated from photoconductive surface with light to dissipate any residual electrostatic charge remaining prior to the charging thereof for the successive imaging cycle.

While the present image enhancing invention has been described in a preferred tri-level imaging embodiment employing two component development, it should be understood that the invention is equally effective in image development systems in general, especially those that use a single development station (monochrome), multi-development stations (e.g., process color) single component toner, three component developer or an image on image electrostatic system.

Alternatively, the pre-transfer image modification system of the present invention could be implemented into a variety of xerographic systems, such as, for example, in U.S. Pat. No. 5,276,484 where a photoreceptor belt contains an integral piezoelectric polymer layer to enable acoustic exication by controlled application of an electric field to its back surface with a shoe electrode, roll or corona contact.

It is, therefore, evident that there has been provided in accordance with the present invention a means to enhance image quality in systems that normally suffer from image noise attributed to carrier effects in two component development processes that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A method of enhancing image quality and removing edge raggedness from tri-level images, said method including the steps of:

providing a charge retentive surface;

forming a tri-level latent electrostatic image on said charge retentive surface, said image comprising a first image area at a relatively high voltage level, a second image area at a relatively low voltage level and a background area half way between the voltage levels of said relatively high and low voltage levels;

electrically biasing a first developer member to a voltage level that is offset from said background area, in the direction of said first image area;

electrically biasing a second developer member to a voltage level that is offset from said background area, in the direction of said second image area;

using said first developer member to develop said first image area;

vibrating said charge retentive surface with a first transducer;

using said second developer member to develop said second image area in a color different from said first image area; and then vibrating said charge retentive surface with a second transducer to thereby fill in solid area toner void lines and improve image edge sharpness.

2. The method of claim 1, including performing the steps of vibrating said charge retentive surface with ultrasonic probes.

3. Apparatus for removing diminishing edge raggedness and increasing solid area coverage of tri-level images, said apparatus comprising:

a charge retentive surface;

a device for forming a tri-level latent electrostatic image on said charge retentive surface, said image comprising a first image area at a relatively high voltage level, a second image area at a relatively low voltage level and a background area half way between the voltage levels of said relatively high and low voltage levels;

a first development system including means for applying a first conductive magnetic brush developer to said charge retentive surface for developing said first image area and means for electrically biasing a first developer member to a voltage level that is offset from said background area, in the direction of said first image area;

a second development system including means for applying said second conductive magnetic brush developer to said charge retentive surface for developing said second image area in a color different from said first image area and means for electrically biasing a second developer member to a voltage level that is offset from said background area, in the direction of said second image area; and pre-transfer image modification members positioned downstream of each of said first and second development systems, said pre-transfer image modification members being adapted to reduce adhesion of toner to said charge retentive surface to allow mutual repulsion of like charged toner particles to uniformly distribute toners within boundaries defined by said tri-level latent electrostatic image, and thereby reduce image noise on said tri-level latent electrostatic image.

4. The apparatus of claim 3, wherein said pre-transfer modification members are vibrator members for vibrating said charge retentive surface.

5. The apparatus of claim 4, wherein said vibrator members are ultrasonic probes.

6. Apparatus for ensuring development of edges and reducing solid area image noise of a previously developed image, said apparatus comprising:

means for forming an electrostatic image on a charge retentive surface;

a development apparatus for rendering said image visible; and a vibrator member positioned downstream of said development apparatus and upstream of an image transfer apparatus, said vibrator member being adapted to vibrate the charge retentive surface in order to reduce solid area image noise and/or remove edge raggedness from said image.

7. The apparatus of claim 6, wherein said vibrator member is an acoustic transducer.

8. A method of ensuring development of edges and reducing solid area image noise of a previously developed image, comprising the steps of:

forming an electrostatic image on a charge retentive surface;

providing a development apparatus and rendering said image visible;

positioning a vibrator member downstream of said development apparatus and upstream of an image transfer apparatus, and vibrating said vibrator member to vibrate the charge retentive surface in order to reduce solid area image noise and/or remove edge raggedness from said image.

9. The method of claim 8, including the step of providing an acoustic transducer as said vibrator member.

10. The method of claim 8, including the step of providing an acoustic horn as said vibrator member.

* * * * *